United States Patent [19]

Steers et al.

[11] Patent Number: 4,803,342

[45] Date of Patent: Feb. 7, 1989

[54] FLAT-IRON SAFETY DEVICE UTILIZING A DUAL INTERNAL TIMING CIRCUIT

[75] Inventors: Michel Steers, La Queue en Brie; Michel Courdille; Jean-Pierre Hazan, both of Sucy en Brie, all of France

[73] Assignee: U.S. Philips Corp., New York, N.Y.

[21] Appl. No.: 937,597

[22] Filed: Dec. 3, 1986

[30] Foreign Application Priority Data

Dec. 6, 1985 [FR] France ..... 8518102

[51] Int. Cl.[4] ..... H05B 1/02; D06F 75/26

[52] U.S. Cl. ..... 219/257; 38/75; 200/61.45 R; 200/61.52; 219/251

[58] Field of Search ..... 219/245–259; 38/75, 82, 79; 200/61.5

[56] References Cited

U.S. PATENT DOCUMENTS

| | | | |
|---|---|---|---|
| 2,143,701 | 1/1939 | Kelley et al. | 219/250 X |
| 2,274,390 | 2/1942 | Weeks | 219/255 X |
| 2,382,587 | 8/1945 | Thomas | 219/257 |
| 2,470,532 | 5/1949 | Thomas | 219/257 |
| 2,833,903 | 5/1958 | Waddell | 219/251 X |
| 4,130,955 | 12/1978 | Baumgartner et al. | 219/257 X |
| 4,203,101 | 5/1980 | Towsend | 219/257 X |
| 4,520,257 | 5/1985 | Schwob et al. | 219/257 X |
| 4,580,038 | 4/1986 | O'Loughlin | 219/252 X |
| 4,661,685 | 4/1987 | Comtri | 219/250 |

FOREIGN PATENT DOCUMENTS

| | | | |
|---|---|---|---|
| 1246903 | 8/1967 | Fed. Rep. of Germany | 219/253 |
| 2158105 | 11/1985 | United Kingdom | 219/250 |

*Primary Examiner*—Anthony Bartis

*Attorney, Agent, or Firm*—Ernestine C. Bartlett

[57] ABSTRACT

An electric flat-iron safety device includes a magnet pivotally supported in a flat-iron and arranged to actuate a first magnetically operated switch only when the flat-iron is in a horizontal ironing position and to actuate a second magnetically operated switch only when the flat-iron as tilted to a vertical rest position. Should the flat-iron remain motionless in the horizontal ironing position for a first predetermined time interval shorter than the time necessary for the flat-iron to reach its normal operating temperature, closure of the first switch by the magnet causes a resettable dual interval timing circuit to interrupt the power supply to the flat-iron. If the flat-iron remains motionless in the vertical tilted rest position for a second predetermined time for a interval longer than the time necessary for the flat-iron to reach its normal operating temperature, closure of the second switch by the magnet causes the dual interval timing circuit to interrupt the power supply. The dual interval timing the first or second switch opens in response to pivotal movement of the magnet prior to expiration of the first or second time interval.

7 Claims, 1 Drawing Sheet

FLAT-IRON SAFETY DEVICE UTILIZING A DUAL INTERNAL TIMING CIRCUIT

The invention relates to an electric flat-iron provided with an automatic safety device. The device includes a movable body which moves in a substantially horizontal direction when the iron is moved during ironing, and which co-operates with a switch controlling a timing circuit which causes the power supply of the iron to be interrupted when it has been inoperative for a predetermined time interval.

An apparatus of this kind is known from FR No. 2,540,148. This document describes an electronic safety device for an electric flat-iron. The device comprises a movable body which cooperates with a switch and a timing circuit. This movable body comprises a permanent magnet which moves inside a recess in the iron when the iron is moved in a substantially horizontal direction during ironing. The switch causes the timing circuit to be reset to zero. When the iron is not moved the movable body does not actuate the switch so that the timing circuit is not reset to zero and at the end of the predetermined time interval defined by the timing circuit this circuit drives the gate of a triac to interrupt the power supply to the flat-iron.

However, this device has some drawbacks. In order to allow for the energization of the iron when it is cold, the predetermined time interval after which the power supply is interrupted is selected to be long enough to allow the iron to reach the selected temperature. This predetermined time is therefore comparatively long, of the order of five minutes.

When the iron is not moved after it has been energised and placed in the customary horizontal working position, its soleplate may be in contact with the fabric to be ironed and the comparatively long predetermined time necessary for warming up the iron is then liable to be too long in order not to cause any damage to the fabric.

However, it is evident that it is not possible either to make this predetermined time shorter than the time necessary for the iron to reach its normal operating temperature.

Therefore, it is an object of the invention to mitigate these drawbacks which may lead to damage to the fabrics.

SUMMARY OF THE INVENTION

To this end the invention as defined in the opening paragraph is characterized in that the timing circuit controlled by the switch causes the power supply to be interrupted after a predetermined time interval shorter than the time taken by the iron to reach its normal operating temperature. The movable body cooperates with another switch when the flat-iron is brought into a substantially vertical warming-up or waiting position, the other switch controlling another timing circuit which causes the power supply to the iron to be interrupted after another predetermined time interval of non-use longer than the time taken by the iron to reach its normal operating temperature.

The movable body comprises a permanent magnet which is pivotal about an axis. Suitably, this magnet is mounted on the end of a pin whose other end is mounted on a rotary spindle in such a way that the permanent magnet and the pin form a pendulum.

The switch and the other switch each comprise a circuit breaker with flexible contacts which cooperate with the movable body. When the flat-iron is in a substantially horizontal position the movable body cooperates with the switch and when the flat-iron is in a substantially vertical position the movable body cooperates with the other switch. Thus, the movable body cooperates either with the switch or the other switch depending on whether the flat-iron is in the horizontal or the vertical position.

The switch controls a timing circuit which causes the power supply to the iron to be interrupted after a predetermined time interval shorter than the time taken by the iron to reach its normal operating temperature.

Similarly, the other switch controls the other timing circuit which causes the power supply to the iron to be interrupted after a predetermined time interval longer than the time taken by the iron to reach its normal operating temperature.

Thus, when the iron is in the horizontal position the predetermined time interval is short and thereby substantially reduces the likelihood of damage to the fabrics. Conversely, when the iron is in the vertical position the predetermined time interval is long enough to allow the iron to reach its operating temperature.

BRIEF DESCRIPTION OF THE FIGURES

The invention will now be described in more detail, by way of example, with reference to the accompanying drawings, in which.

DESCRIPTION OF THE PREFERRED EMBODIMENT

Figure 1B:
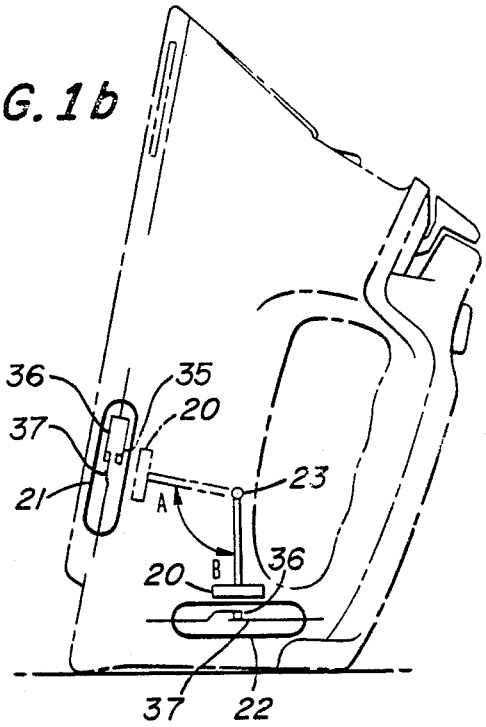
FIG. 1*b* shows how the two switches and magnet interact when the iron is in the vertical position.
Figure 1A:
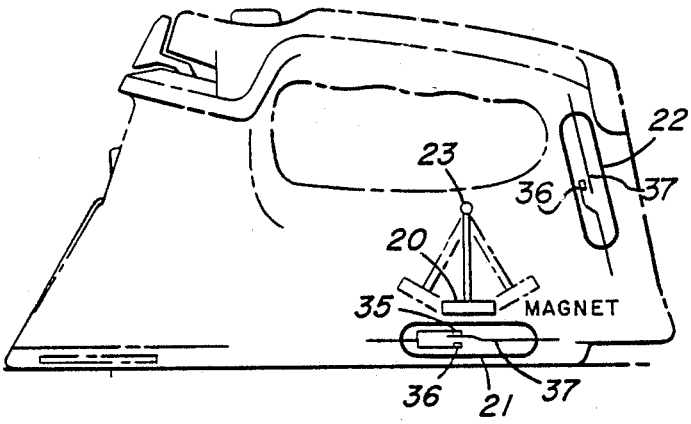
FIG. 1*a* shows how the two switches functioning as circuit breakers with flexible contacts arranged relative to the movable magnet when the iron is in the horizontal position.

FIGS. 1*a* and 1*b* show how the two switches 21, 22 and the movable magnet 20 are arranged relative to each other. The magnet is pivotal about the spindle 23. Thus, it can assume position A when the flat-iron is brought into a subtantially horizontal position as in FIG. 1*a*. However, when the iron is in a substantially vertical position the force of gravity ensures that the movable magnet remains in the vertical position relative to the floor, but as a result of the tilting movement of the iron the movable magnet then cooperates with the switch 22. The latter situation is indicated by the letter B and is represented schematically in FIG. 1*b*.

Figure 2:
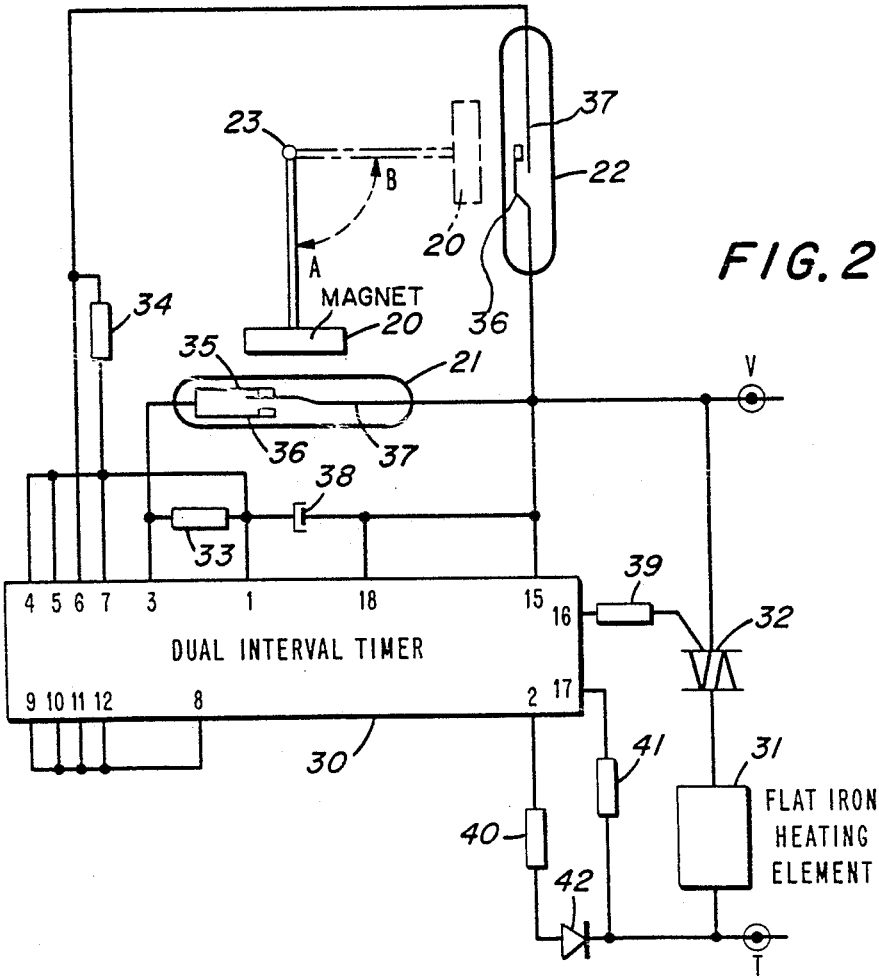
FIG. 2 is a circuit diagram of the automatic safety device in the flat-iron in accordance with the invention.

FIG. 2 shows the circuit diagram of the automatic safety device in the flat-iron in accordance with the invention, which device comprises the following essential elements: the switches 21, 22 with flexible contacts, the movable magnet 20, a timing circuit 30, a heating element 31 arranged in the soleplate of the iron, and a triac 32 controlling the power supply to the heating element 31.

Preferably, the timing circuit 30 is a circuit of the type SAB 529 manufactured by SIEMENS (Federal Republic of Germany). This circuit SAB529 enables the short and the long predetermined time intervals to be combined in one device. It comprises a START input (pin 3) which, when actuated, starts the short time interval and a multiplier input (pin 6) which, when actuated, multiplies the short time interval by 10 in order to obtain the long time interval. By means of a resistor 34 the multiplier pin 6 is connected to the pins 7, 5 and 4 and to a terminal of the switch 22. The pins 4, 5, 6 and 7 influence a multiplication factor for the predetermined time intervals. The pin 6 is always at potential of 0 V when the switch 22 is open. The other terminal of the switch 22 is connected to the pin 15, which determines the mode of operation of the triac. The START pin 3 is connected to the switch 21 with flexible contacts. This is a double switch of the type whose movable flexible contact can come into contact with two different terminals 35, 36 depending on whether the magnet 20 actuates or does not actuate the switch 21. The two terminals 35, 36 are interconnected and connected to the pin 3 of the circuit 30. When the flexible contact 37 is in the position in which it is changing between the terminal 36 and the terminal 35 or the other way around, it is floating for a such time that self-starting of the timing circuit is possible. The flexible contact 37 is connected to the pin 15 and to the switch 22. A resistor 33 is arranged between the pins 1 and 3 in such a way that the pin 1 always at a potential of V volts, except when the switch 21 is open. A filter capacitor 38 is arranged between the pins 1 and 18. The pins 4, 5, 7 and 1 are interconnected, and so are the pins 8, 9, 10, 11 and 12 which determine the length of the selected pre-determined time intervals (15 seconds in the present example).

The device operates as follows. When the iron is placed in the substantially vertical position (FIG. 1*b*), the switch 22 is closed and as soon as the circuit 30 is actuated, a predetermined time interval of, for example, $10 \times 15$ seconds$=150$ seconds begins to expire. This time interval is sufficient to allow the iron to reach its operating temperature. Since the magnet 20 is in position B the flexible contact 37 of the switch 21 is in contact with the pin 36. When the iron is placed in the substantially horizontal position (FIG. 1*a*) the magnet 20 is in position A and the flexible contact 37 is in contact with the pin 35 and the switch 22 is open. Upon each movement of the iron in the horizontal direction the movable magnet 20 performs a tilting movement, causing the contact between the flexible contact 37 and the pin 35 to be broken and subsequently remade. This sequence of interruptions causes the timing circuit to be reset to zero. The timing circuit can proceed only when the iron is no longer moved. Starting takes place when the flexible contact 37 is floating and not in contact with pin 35 or 36.

An electric signal corresponding to the short time interval or the long time interval is applied to the pin 16, which is connected to the gate of the triac 32 by a resistor 39, which triac is arranged in series with the heating element 31. The two last-mentioned elements are connected to the mains-voltage terminals V and T. A resistor 40 and a diode 42 are connected in series between the pin 2 and the mains-voltage terminal T. A resistor 41 is connected between the pin 17 and the terminal T to provide synchronization of the triac.

What is claimed:

1. A safety device for controlling the supply of heating current to an electric flat iron comprising a movable permanent magnet adapted to be positioned in an iron and arranged for movement in a substantially horizontal direction in response to the iron being moved during ironing and actuating a first switch controlling a first timing circuit for causing the heating current supply of the iron to be interrupted in response to said permanent magnet having been motionless in said horizontal position for a predetermined time interval, characterized in that said first timing circuit is arranged to cause the power supply to be interrupted after a first predetermined time interval shorter than the time taken by the iron to reach its normal operating temperature and in that said movable permanent magnet actuates a second switch in response to the flat-iron being brought into a substantially vertical warming-up or waiting position, said second switch controlling another timing circuit to cause the heating current supply to the iron to be interrupted after a second predetermined time interval of non-use in said vertical position longer than the time taken by the iron to reach its normal operating temperature.

2. A safety device as claimed in claim 1, wherein the movable permanent magnet is pivotal about an axis for actuating said switches.

3. A safety device as claimed in claim 2, wherein the permanent magnet is mounted on the end of a pin whose other end is mounted on a rotary spindle in such a way that the permanent magnet and the pin from a pendulum about an axis.

4. A safety device as claimed in the claim 1, wherein the first switch and the other second switch each comprise a circuit breaker with flexible contacts.

5. An electric flat-iron safety device comprising:

a permanent magnet adapted to be pivotally supported in a flat-iron;

first and second magnetically operated switches operably associated with said permanent magnet, said switches disposed at substantially right angles with each other, said movable magnet being located adjacent said first switch for operation of said first switch only when the flat-iron is in a horizontal ironing position, said movable magnet being located adjacent said second switch for operation thereof only when the flat-iron is tilted vertically to a rest position;

a timing circuit having first and second inputs, said first input being connected to said first switch for initiating a first time interval upon the closure of said first switch by said magnet when said flat-iron is motionless in a horizontal ironing position, said first time interval being reset each time said first switch opens in response to movement of the iron in said horizontal position prior to the expiration of said first time interval, said second input being connected to said second switch for generating a second time interval longer than said first time interval, by the closure of said second switch by said magnet in response to said iron being set to its vertical rest position, said first time interval being shorter than and said second time interval being longer than the time taken by the flat-iron to reach its normal operating temperature; and means for disabling a heating current supplied to said flat-iron when said timing circuit generates an output signal indicating that one of said first or second time intervals has expired without interruption, whereby said flat-iron heating current is disabled when said iron has not been moved horizontally during a time equal to said first time interval, and is disabled when said iron has been placed in a vertical position for a time equal to said longer interval.

6. The electric flat iron safety device of claim 5 wherein said second time interval is substantially ten times said first time interval.

7. The electric flat safety device of claim 6 wherein said second time interval is substantially 150 seconds.

* * * * *